United States Patent [19]

Bornhauser

[11] Patent Number: 4,498,489

[45] Date of Patent: Feb. 12, 1985

[54] HAIR CURLER

[76] Inventor: Heinz K. Bornhauser, Zwinglistrasse 21, 9000 St. Gallen, Switzerland

[21] Appl. No.: 548,020

[22] Filed: Nov. 1, 1983

Related U.S. Application Data

[63] Continuation of Ser. No. 337,905, Jan. 7, 1982, abandoned.

[30] Foreign Application Priority Data

Jan. 16, 1981 [CH] Switzerland ..... 286/81

[51] Int. Cl.[3] ..... A45D 2/00

[52] U.S. Cl. ..... 132/40; 132/32 R; 132/39; 132/31 R

[58] Field of Search ..... 132/40, 39, 32 R, 31 R

[56] References Cited

U.S. PATENT DOCUMENTS

| | | | |
|---|---|---|---|
| 1,116,935 | 11/1914 | Sénégas | 132/39 |
| 1,370,932 | 3/1921 | Tolman . | |
| 1,889,691 | 11/1932 | DeRequesens . | |

FOREIGN PATENT DOCUMENTS

| | | | |
|---|---|---|---|
| 2753980 | 6/1979 | Fed. Rep. of Germany | 132/40 |
| 24586 | 9/1922 | France . | |
| 554659 | 6/1923 | France . | |
| 923098 | 2/1947 | France . | |
| 2436581 | 9/1978 | France | 132/40 |
| 271522 | 10/1950 | Switzerland . | |
| 56605 | 7/1982 | Switzerland | 132/31 R |

*Primary Examiner*—Gregory E. McNeill
*Attorney, Agent, or Firm*—Ladas & Parry

[57] ABSTRACT

A hair curler comprising an elongated curler body, having a circular cross-sectional configuration. The curler body has at least two curvilinearly extending portions with a longitudinal extent thereof being shorter than or equal to the cross-sectional diameter of the curler. Longitudinal planes of the curvilinearly extending portion intersect each other at an angle of approximately ninety degrees. The successive curvilinearly extending portions differ regarding their direction of curvature.

5 Claims, 5 Drawing Figures

HAIR CURLER

This application is a continuation of Ser. No. 337,905, filed Jan. 7, 1982, now abandoned.

BACKGROUND OF THE INVENTION

1. Field of the Invention

The present invention relates to an improved hair curler having an elongated curler body. The invention relates further to a method of chemically and/or physically curling hair by application of a hair curler having an elongated curler body which comprises at least two curvilinearly extending sections whereby successive curvilinearly extending sections differ regarding the direction of curvature.

2. Description of the Prior Art

Hair curlers which are used to curl hair by chemical and/or physical procedures are generally known. The general known procedure is to wind the hair which previously has been usually shampooed and divided into strands onto a hair curler and thereafter the hair is made subject to a chemical or physical treatment. The generally known curlers comprise mostly a cylindrical cross-sectional shape which leads to the fact that similar and equal shapes of the curls of the hair are arrived at, which shape however does not correspond to a natural shape of the human hair. A strand of a natural curled hair is characterized in that it comprises in succession so-called open curls and closed curls, the latter having a curvature extending in the direction opposite to the one of the former curls. Thereby an open curl is a curl having a large radius of curvature and a closed curl is a curl having a small radius of curvature. Adjacent sections of hairs of a strand of hair of natural curls do not form together, however, an open and closed curl. It rather is a fact that at the location where the outer circumferential area of a given strand describes an open curl; the oppositely located circumferential area of such strand describes a closed curl. Accordingly, a closed curl at the one side of a naturally curled strand extends at the same distance of the hair from the skin of the head smoothly into a open curl at the other side of such strand. In order now to more or less copy such shape it is known to wind strands of hair around conically extending curlers whereby the strands, at an initial winding at the large and the small diameter of the curler, are wound in succession. By means of brushing together the strands after treatment it is possible to form an irregular curling. The effect is, however, regarding the sought copying of natural curls not satisfactory and the expenditure time to complete such curls is considerably large.

SUMMARY OF THE INVENTION

Hence, it is a general object of the present invention to provide an improved construction of a hair curler which causes naturally looking curls. A further object is to provide a method of winding hair around a curler such that naturally looking curls are formed.

Now, in order to implement these and still further objects of the invention, which will become more readily apparent as the description proceeds, the hair curler of this development comprises at least two curvilinearly extending sections whereby successive curvilinearly extending sections differ regarding their direction of curvature. These and other objects are implemented furthermore by a method comprising the steps of dividing the hair portion to be curled into a plurality of strands, of winding every strand around said curler body in the form of a criss-cross winding of which the number of intersections equals the number of curvilinearly extending sections such that the peripheral areas of every strand are bestowed in succession small and large circumferences whereby at any large circumferential of the one said area the other said area comprises a small circumference and vice versa.

BRIEF DESCRIPTION OF THE DRAWINGS

The present invention will be more fully understood by reference to the following detailed description thereof when read in conjunction with the attached drawings, and where.

DETAILED DESCRIPTION OF THE PREFERRED EMBODIMENTS

Figure 1:
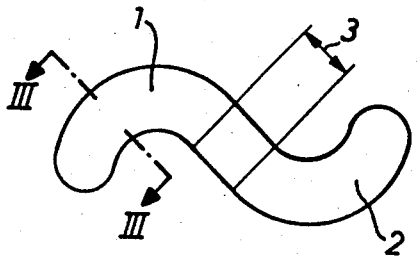
FIG. 1 is a view of a curler body shaped in accordance with the present invention.
Figure 3:
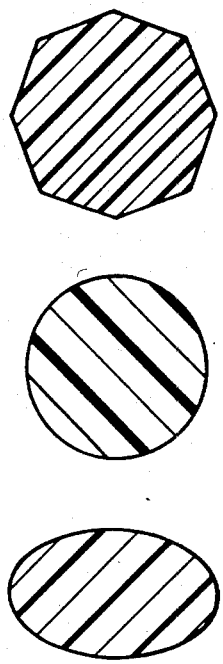
FIG. 3 shows several embodiments of cross-sectional shapes of the curler body shown in FIG. 1.

Describing now the drawings and considering initially the embodiment as shown in FIG. 1, it will be understood that same comprises a curler body having a curvilinearly extending section 1 and the curvilinearly extending section 2 whereby the direction of curvature of section 2 extends oppositely to the extent of curvature of section 1. Intermediate of both curvilinearly extending sections 1 and 2, a rectilinearly extending section 3 is interposed. The preferred length of this rectilinear section 3 is not larger than the cross-sectional diameter of the curler body. All three sections are arranged in a common plane. FIG. 3 depicts possible cross-sectional areas of the curler body. The middle shape is a circular cross section, the upper shape a polygonal cross section and the lower shape an elliptical cross section. The use of a curler body having a cross-sectional shape which is different from the circular cross-sectional shape can be in such cases advantageous in which an increased adhering of the hair on the curler body is needed. It is, however, of importance, that the polygon shape comprises a large enough number of corners such that they are obtuse enough to avoid a breaking of the hairs. If a smooth transition from an open to a closed curl is sought, an elliptical cross-sectional shape is preferably used. Other irregular cross-sectional shapes can be used in such cases in which an irregular wave form, i.e. curling of the hair, is requested. The material from which the curler body is made is such that it can resist the known chemical and/or physical handling of the hair which may have an influence on particular materials. Preferably the material is a plastic material, however, metals and their alloys as well as wood are also practically usable materials.

Figure 2:
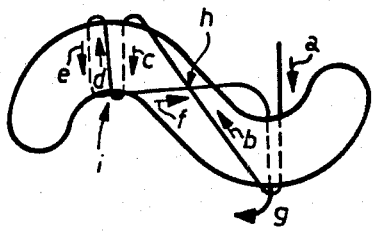
FIG. 2 is a schematic design of winding hair around the curler body shown in FIG. 1.

The principal curling or winding scheme of one strand of hair is shown in FIG. 2. The following example is based on the assumption that $3\frac{1}{2}$ winding rotations are necessary to wind the strand completely around the curler body. A corresponding curler comprises in such cases a length from about 3 to $3\frac{1}{2}$ cm. and its cross-sectional diameter will amount to about 1 cm. The shampooed hair is divided into strands of a width of about 2 cm and wound around the curler bodies in the form of a criss-crossed winding. In order to hold the tip area of a strand they will be arranged in one of the curvatures 1, 2 of the hair curler body followed by one curling rotation around the respective curvilinearly extending section until the winding slightly overlaps the tip of the hair. This initial winding which serves solely for holding the tip of the strand is not shown in FIG. 2; the not held tip is designated by a. By means of a further rotation of the curler the strand will be oriented in direction b and c, whereupon a further winding is made around the second curvlinearly extending section along d and e, which winding ends at a first intersection i. By means of a further half rotation the strand reaches along f a second intersection H, whereupon as shown by f and g the hair strand leads to the skin of the head and forms a beginning wave. It must be thereby borne in mind that the width of the strand amounts to $\frac{2}{3}$ of the longitudinal extent of the curler body such that the criss-crossed winding defines at the points of intersections smaller or sharper, respectively, obtuse angles in comparison with the winding scheme as shown to illustrate the basic curling in FIG. 2. Regarding the direction along which the first wave or first half-wave extends in the direction away from the skin of the head, it is decisive if the curling ends at the left or at the right curvilinear section of the curler body. If the curling ends at the right hand section, the curling begins to the right; if it ends at the left curve, the curling begins to the left whereby the angle of the longitudinal direction of the curler body relative to the skin of the head determines also the angle of the curl extending therefrom. Accordingly, when an angle of 90° is present, a natural flat curl is formed. Based on this possibility to predetermine the angle of the curl by means of a corresponding location of the curl relative to the skin of the head a large variety of possibilities in forming hair styles is possible. The curler will be held or arrested by use of common arresting means such as e.g. needles, clamps or rubber bands. The hairs which have been wound as set forth above will be given a permanent wave by means of known methods, be this of chemical and/or physical nature. After the hairs have been wound off the curlers, they will have a curling which cannot be differentiated from natural curlings because this artificial curling corresponds regarding the successive wave shapes to the natural curls. According to the above described example encompassing $3\frac{1}{2}$ curling rotations an open, a closed as well as an initial wave are shaped. A shaping of the hair achieved in this manner has furthermore the advantage that it can quite easily be taken care of and may also be, for instance, after repeated washing again brought extremely easily into the previously given shape.

Figure 4:
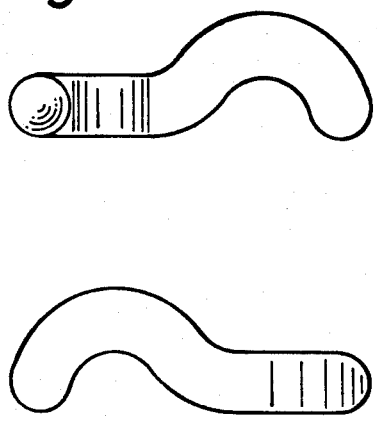
FIG. 4 is a further embodiment of the inventive curler body.
Figure 5:
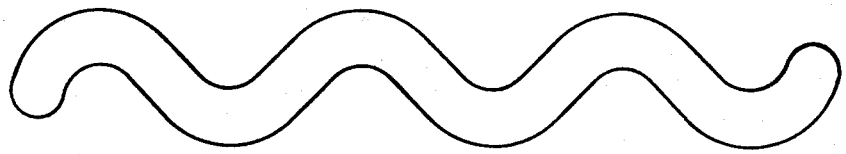
FIG. 5 is yet a further embodiment of the curler body according to the invention.

In FIGS. 4 and 5 further preferred embodiments of the inventive hair curler are shown. The two curvilinearly extending sections of the curler in accordance with FIG. 4 do not extend in the common plane as is the case of the curler of FIG. 1, they rather extend in planes offset by 90° from each other. This curler is specifically advantageous in case of short hairs which cannot have a complete last winding. The hair curler according to FIG. 5 is used for long hairs which curler comprises more than two curvilinearly extending sections; in the shown embodiment it consists of 6 sections. The method of winding the hair when using these curlers is basically the same as described with reference to FIG. 2 with the exception, that after some few criss-cross windings have been made, for instance, on the two curvilinear sections at the left, one or several criss-cross windings are applied on the two center curvilinearly extending sections and finally the two curvilinear sections at the right hand side will receive criss-cross windings, which windings end at the right hand outermost sections.

The above described inventive curlers allow in use for shaping hair for the first time a shaping of curls or waves which practically completely correspond to a natural curling, whereby the curlers can be embodied as to be suitable for use with any given length of the hair.

While there are shown and described present preferred embodiments of the invention, it is to be distinctly understood that the invention is not limited thereto, but may be otherwise variously embodied and practiced within the scope of the following claims. Accordingly,

What is claimed is:

1. A hair curler, comprising: an elongated curler body having a circular cross-sectional configuration, said curler body having at least two curvilinearly extending portions with a longitudinal extent thereof being shorter than or equal to the cross-sectional diameter of the curler, longitudinal planes of said curvilinearly extending portions intersect each other at an angle of approximately ninety degrees, said successive curvilinearly extending portions differ regarding their direction of curvature; and at least one rectilinearly extending portion arranged intermediate said curvilinearly extending portions is such manner that said curvilinearly extending portions extend away from said rectilinearly extending portion.

2. A hair curler, comprising: an elongated curler body having a circular cross-sectional configuration, said curler body having at least two curvilinearly extending portions with a longitudinal extent thereof being shorter than or equal to the cross-sectional diameter of the curler, longitudinal planes of said curvilinearly extending portions intersect each other at an angle of approximately ninety degrees, said successive curvilinearly extending portions differ regarding their direction of curvature.

3. A method of curling hair by application of a hair curler having an elongated curler body which comprises at least two curvilinearly extending sections wherein successive curvilinearly extending sections differ regarding their direction of curvature comprising the steps of dividing the hair portion to be curled into a plurality of strands, of winding every strand around said curler body in form of a criss-crossed winding of which the number of intersections equals the number of curvilinearly extending sections and wherein said intersections are alternatingly located on the inner curvature of said curvilinearly extending sections and on the areas of transition between said curvilinearly extending sections whereby every strand of hair which has been curled by said hair curler has a wave having a relatively smaller radius of curvature followed by a wave having a relatively larger radius of curvature.

4. The method of claim 3, wherein upon completion of winding said strands of hair said curlers are placed relative to the skin of the human head such that said strands project in a predetermined angle from said skin.

5. The method of claim 3, wherein the width of said strands amounts to about two-thirds of the longitudinal extent of any two successive sections.

* * * * *